United States Patent [19]

Ferreira-Godinho

[11] Patent Number: 4,842,434

[45] Date of Patent: Jun. 27, 1989

[54] ORGANIZATIONAL AID FOR PAPER SHEETS, ESPECIALLY EDP PAPER SHEETS

[76] Inventor: Manuel Ferreira-Godinho, Bergiusweg 10, D-3250 Hameln 1, Fed. Rep. of Germany

[21] Appl. No.: 113,885

[22] Filed: Oct. 27, 1987

[51] Int. Cl.[4] ..... B42F 3/04; B42F 13/00; G09F 3/18; B41J 11/54

[52] U.S. Cl. ..... 402/34; 402/80 R; 40/352; 40/649

[58] Field of Search ..... 402/26, 29, 31, 32, 402/33, 36, 37, 46, 56, 73, 80 R, 34; 40/10 R, 16, 20 A, 20 R, 109, 352, 60 C; 211/46, 47, 44, 162

[56] References Cited

U.S. PATENT DOCUMENTS

| | | | |
|---|---|---|---|
| 716,232 | 12/1902 | Houghton | 402/80 R |
| 1,132,306 | 3/1915 | Dawson | 402/34 |
| 1,140,360 | 5/1915 | Dawson | 402/34 |
| 2,871,816 | 2/1959 | McDonnell | 40/352 |
| 3,638,801 | 2/1972 | Larson | 211/162 |
| 4,055,908 | 11/1977 | Greene | 40/352 |
| 4,472,897 | 9/1984 | Phillips | 40/16 |
| 4,473,158 | 9/1984 | Barber | 211/162 |
| 4,486,111 | 12/1984 | Hulber et al. | 402/80 P |

FOREIGN PATENT DOCUMENTS

| | | | |
|---|---|---|---|
| 3607801 | 11/1987 | Fed. Rep. of Germany | 402/80 R |

*Primary Examiner*—Frank T. Yost
*Assistant Examiner*—Paul M. Heyrana, Sr.
*Attorney, Agent, or Firm*—Andrus, Sceales, Starke & Sawall

[57] ABSTRACT

An organizational aid for EDP paper sheets is provided which permits adaptation to different EDP paper sizes. To this end the feed holes (15) located at the side margins of EDP paper sheets (11) are utilized. A fixed carrier member (10) has mounting elements (20, 26, 28) disposed thereon which comprise a bar (20) and two holding members (26, 28). U-shaped clamps (40) for accommodating and fixing the paper sheets (11) are detachably secured in the holding members (26, 28). One (28) of said holding members is movable along the longitudinal direction of the bar (20) while the other holding member (26) is fixedly joined to the bar (20) (FIG. 1).

21 Claims, 3 Drawing Sheets

20
22
23
28
42
44
46
50
51
53
54
55
56
57
58
59
60
61
62
63
64
65
66
B1
D1

ORGANIZATIONAL AID FOR PAPER SHEETS, ESPECIALLY EDP PAPER SHEETS

BACKGROUND OF THE INVENTION

The present invention is directed to an organizational aid for paper sheets, especially EDP paper sheets, each of which includes along the side margin thereof a series of equi-distantly spaced punched holes, said organizational aid comprising a strong carrier member having holding elements mounted thereon, and comprising U-shaped clamps detachably secured in said holding means for accommodating and fixing the paper sheets.

Various configurations for such organizational aids have already been proposed, which serve the purpose, for instance, to accommodate computer-printed lists, programmes, analysis sheets or the like. These may be either separate paper sheets or stacks of paper sheets which are optionally zig-zag folded. The feed holes along the margins of the paper sheets, which are provided in any case, are utilized for securing the paper sheets so that it is unnecessary to provide additional holes which would possibly have to be formed in the printed area of the paper sheets.

In respect of such EDP paper sheets there arises the problem, however, that different sizes or formats are used in practice. There are, for instance, oblong sizes having a height of 203 mm and 228 mm and a width of 305 mm, 315 mm and 322 mm. In order to accommodate these different EDP paper sizes, numerous configurations of organizational aids have already been proposed in which provision has been made for adjustment to match with the respective EDP paper sizes.

But it has been found that the previous configurations are not completely satisfactory when used in practice, because due to the fact that the organizational aids are adjustable they lack sufficient strength. For this reason some organizational aids can be stored only in horizontal position because of lacking stability. But even when stored horizontally, problems of space will arise due to the wedge-like configuration, because the wedge-like structures cannot be stacked very well since the oblique stack would be subject to sliding. In addition to that, the paper sheets accommodated in the organization aid, especially in the vicinity of the punched holes, are subjected to high loads due to the flexible design of the organizational aid, so that the holes may easily be torn out.

It is therefore the object of the present invention to provide an organizational aid of the specified kind which, while being of simple structure, permits ready adaptation to different paper sizes and ensures reliable, damage-free accommodation of the paper sheets.

SUMMARY OF THE INVENTION

The solution of the above-specified object in accordance with the present invention resides in that an organizational aid of the specified kind is designed such that the holding means includes a bar as well as an upper and a lower holding member extending transversely to the bar, that the lower holding member is fixedly joined to the bar and the upper holding member is arranged to be movable along the longitudinal direction of the bar, and that the two holding members are adapted to releasably receive the clamps.

The organizational aid according to the present invention solves the specified object in a satisfactory and advantageous way. The lower holding member is fixedly joined to the bar which is provided on the holding means. Thereby the main load caused by the accommodated paper sheets is absorbed at this location when the organizational aid is stored in upright position. The region of the upper, movably disposed holding member is subjected to substantially smaller loads so that the movability of the upper holding member has no detrimental effect on the strength of the overall arrangement.

As a further improvement of the present invention it is provided that the holding means is made from metal or plastic material, especially of injection moulded parts. It is particularly advantageous when the components of the holding means are made from polyolefin, especially polypropylene or polyurethane. Such parts can be manufactured with functional design in a simple way with high accuracy and an attractive exterior.

Appropriately, the bar and the lower holding member are integrally formed and fixedly joined to the carrier member by welding, gluing, screwing and/or riveting. This also adds to the strength of the arrangement.

A further improvement of the invention provides that each of the holding members includes a seating portion and a latching portion extending transversely to the bar in opposite directions for accommodating the U-shaped clamps. Thereby a stable and attractive, symmetrically designed arrangement is obtained.

In accordance with a special embodiment of the present invention each of the holding members includes an open-topped insertion hole at one end thereof and a substantially symmetrical latching portion formed at the opposite end and having a central notch, the clamp after insertion in the insertion hole being releasably locked in the latching portions by rotation about one of its arms. In this way it is possible to push the clamp through the punched holes of the papers sheets into the top of the insertion hole and subsequently to lock the clamp by a suitable rotation either in anticlockwise or clockwise direction.

A further improvement of the present invention provides that the insertion hole and the notch in the latching portion of the lower holding member are disposed at a distance from the lower edge of the carrier member, especially the bottom of a stable folder, which distance corresponds to the standard distance of feed holes of EDP paper sheets from the side edge of the paper. Advantageously, this has the result that the full area of the carrier member, especially the bottom of a stable folder, is utilized and also no space is wasted when the folder is stored in a shelf or the like. Moreover, with such an arrangement the paper stack accommodated in organizational aid itself contributes to the strength of the arrangement in upright storage position while the feed holes with the clamp passing therethrough are not subjected to any high loads.

It is furthermore appropriate that the respective latching portion on the holding member defines a projection which is offset upwardly relative to the underside of the holding member and includes a recess which is continuous in longitudinal direction of the bar and has a predetermined spacing from the carrier member. In that case the clamp can easily engage beneath the latching portion so that the clamp is locked in the respective holding member.

A special embodiment of the present invention provides that the latching portions of the holding members, when viewed from above, are of heart-shaped configuration and, when viewed from the side, have a lesser thickness than the opposite seating portions. Such a configuration presents an attractive design and facilitates insertion and release of the clamps.

A particular advantage is achieved when at least the seating portion and the latching portion of the respective holding members have a surface which is flush with the surface of the bar to extend in coplanar relationship therewith. This has the effect that also in the vicinity of bar and holding members a paper stack accommodated in the organizational aid is flatly supported so that no folds or corrugations result whereby turning of individual paper sheets would be affected.

As a further improvement of the present invention it is provided that the U-shaped clamps each have a longer, straight arm including a shaft and a shorter arm which is bent at the lower end thereof and has a projection extending transversely towards said longer arm. In that case no additional locking means for securing the clamp are required. Rather, the L-configuration of the one arm suffices for detachably securing the clamp in cooperation with the latching portion.

In a special embodiment of the present invention the U-shaped clamp is adapted to be inserted into the respective holding member under initial stress and at a slight inclination of its arm relative to the bottom. The clamp is thereby protected against falling out, on the one hand, and the slight inclination of the arm facilitates turning of individual paper sheets, on the other hand.

In an organizational aid according to the present invention the upper portion of the bar is thinner and is provided in longitudinal direction thereof with a recess on the underside thereof, in which recess the transversely disposed upper holding member is slidably movable beneath the bar by fully utilizing the longitudinal extension of the recess. In this upper portion the upper holding member engages beneath the bar, so that this portion has no protruding parts. Rather, the flush coplanar surface of the arrangement is ensured also in this region.

In this connection it is advantageous when the longitudinal movement of the upper holding member is respectively limited upwardly and downwardly by step-like shoulders and a stop. On the one hand, only a limited range of movement is required and, on the other hand, the strength of the arrangement is not affected thereby. Also, the upper holding member is secured against falling out.

Suitably, the upper holding member and/or the bar are provided in the upper portion thereof with guide means by which the upper holding member is guided for non-rotatable sliding movement. This ensures reliable adjustment or movability without affecting the stability of the arrangement.

In a special modification the bar has at least one longitudinally extending ridge on which a corresponding groove formed in the upper holding member is slidable. This ensures non-rotatability and guiding in a satisfactory way.

In a particular embodiment the bar is of open-bottomed box-like section whose walls in their upper portion define guide ridges for engagement with complementary grooves in the upper holding member. Due to this design no additional parts are required to ensure guiding of the holding member.

In this connection it is advantageous that the upper holding member is formed on the top surface thereof with a recess of such width and depth as to correspond to the width of the bar and the depth of the recess formed in the bar, respectively. This results in a flush and compact assembly without undesirable clearances, the guiding action being enhanced by the interengaging portions of bar and upper holding member.

The stability of the bar and thus of the overall arrangement is enhanced by the feature that at least the upper portion of the bar is provided with a stiffening rib of substantially the same height as the lateral outer guide ridges, said stiffening rib being joined to the upper end stop and optionally to a cylinder integrally formed with the bar, said cylinder being intended to receive a fastening element for fastening the bar.

BRIEF DESCRIPTION OF THE DRAWINGS

Below, further features and advantages of the invention will be described in detail by means of embodiments thereof with reference to the accompanying drawing, in which.

DESCRIPTION OF PREFERRED EMBODIMENTS

Figure 1:
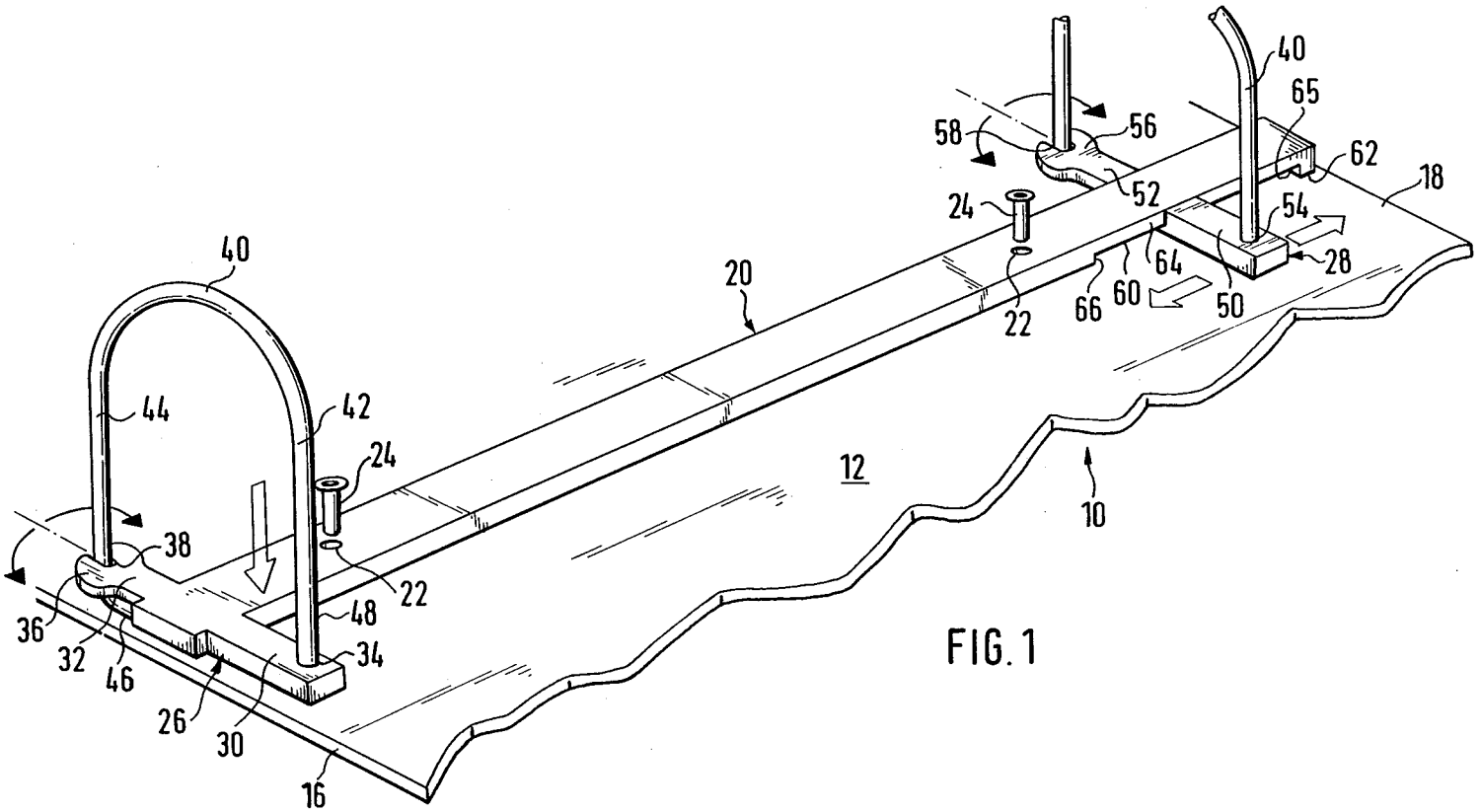
FIG. 1 is a perspective plan view illustrating the organization aid according to the present invention.

FIG. 1 schematically illustrates a carrier member 10 which may, for instance, be formed by the bottom part 12 of a folder which conventionally comprises a bottom part, a back part and a cover part, said parts being joined to each other by permanently foldable creases.

Figure 5:
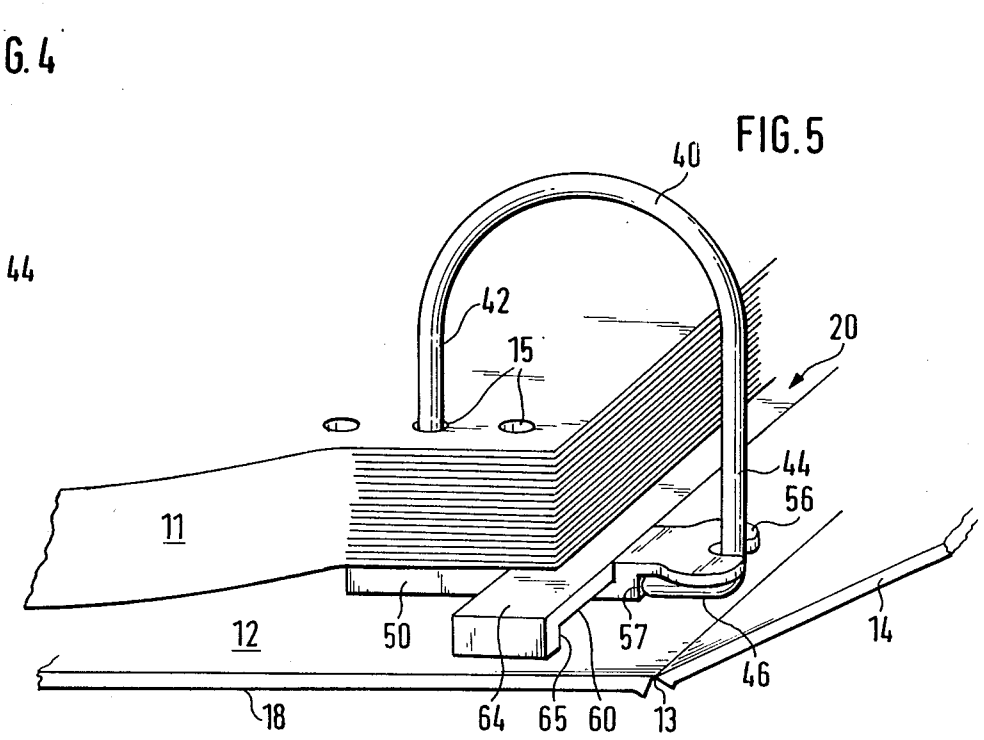
FIG. 5 is a perspective view of the top portion of a bar mounted on a carrier member in use for explaining the way in which paper sheets are received and fixed in the organization aid.

FIG. 5 illustrates schematically an assembly comprised of bottom part 12 and back part 14, said parts being joined to each other by a permanently foldable crease line 13.

FIG. 5 also shows a stack of paper sheets, in particular EDP paper sheets 11 with punched holes, i.e. feed holes 15, along their lateral margins at standardised equal distances, said holes in the present case serving to fix the paper sheets 11 by means of U-shaped clamps 40.

As will be apparent from FIG. 1, the carrier body 10 or the bottom part 12, respectively, has a bar 20 disposed thereon which is fixedly joined to the bottom part 12, for instance by means of fastening elements 24 such as screws or rivets passing through holes 22 in the bar 20 and being joined or fixed to the bottom part 12 in any suitable way. In another embodiment, which is not illustrated, the bar 20 may also be welded or glued to the carrier member 10 or the bottom part 12, respectively.

In FIG. 1, a lower holding member 26 is provided in the vicinity of a lower edge 16 of the bottom part 12, said holding member being either fixedly connected to the bar 20 or integrally formed therewith. At the top end of the bar 20 an upper holding member 28 is provided in the vicinity of an upper edge 18 of the bottom part 12. As indicated by arrows, the upper holding member 28 is adapted for movement along the longitudinal direction of the bar 20.

The bar 20, the lower holding member 26 and the upper holding member 28 constitute the mounting means for the organizational aid and have the function of detachably receiving U-shaped clamps 40 which are likewise illustrated in FIG. 1. The mounting means or, respectively, the parts thereof are suitably made from metal or plastic material, especially of injection moulded parts which can easily be produced with the desired accuracy, shape and colour. Conveniently, the components of the mounting assembly are made from polyolefin, in particular polypropylene or polyurethane. The carrier member 10 or the bottom part 12 are suitably also made from a material such as polypropylene or polyurethane, because these materials are readily moulded or produced by injection moulding while there are no problems in respect of subsequent waste disposal.

Figure 4:
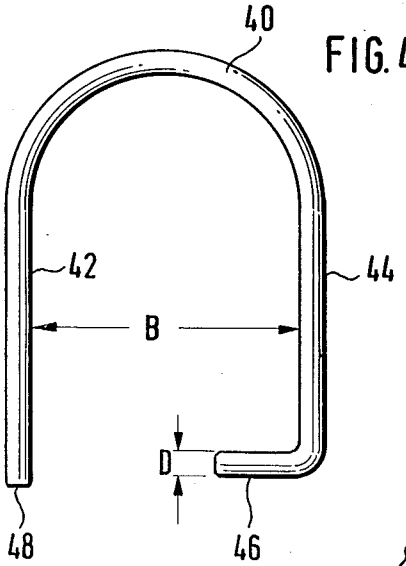
FIG. 4 is a schematic illustration of the clamp.

Each of the two holding members 26 and 28 is formed with a seating portion 30 and 50 and a latching portion 32 and 52, respectively, said portions being respectively provided on opposite sides of the bar 20 which extends transversely thereto. Said portions have the function of accommodating the U-shaped clamps 40 schematically illustrated in FIG. 4. To this end each of the two holding members 26 and 28 is formed with an open-topped insertion hole 34 and 54, respectively, on one end thereof, said insertion hole being formed on the side of the stack of paper sheets 11 to be accommodated. At the opposite ends, substantially symmetrical latching portions 36 and 56 each having a central notch 38 and 58 are respectively provided. It is thereby possible in a simple way to lock a clamp inserted in the insertion hole 34 or 54 by turning the clamp about the axis of its arm 42 in counterclockwise or clockwise direction until it snaps home in the latching portion 36 or 56.

The respective latching portion 36 or 56 constitutes a projection on the holding member 26 or 28, said projection being upwardly offset relative to the underside of the holding member 26 or 28 and including a recess which is continuous in longitudinal direction of the bar 20 at a predetermined distance D1 relative to the carrier member 10 or bottom part 12. As will be apparent especially from FIGS. 1, 2*b* and 3, the latching portions 36 and 56 of the holding members 26 and 28 have heart-shaped contour when viewed from the top and have a lesser thickness than the opposed seating portions 30 and 50 when viewed from the side. Thereby the U-shaped clamps 40 can easily and simply engage beneath said latching portions 36 and 56. In an advantageous embodiment of the invention, the clamps 40 have the configuration illustrated in FIG. 4, in which the one, longer arm 42 is straight and terminates in a shaft 48 to be inserted in the respective insertion hole 34 or 54. The opposite arm 44 is shorter and bent to L-shape at its lower end so that it has a projection 46 which extends transversely to the direction of the longer arm 42. The distance B between the two arms 42 and 44 of the clamp 40 corresponds to an odd multiple of the standardised distances between the feed holes 15 in the EDP paper sheets 11. For instance, the threefold hole spacing between feed holes 15 is suitable for the two arms 42 and 44 which are joined in their upper portion by a semi-circular arc. The U-shaped clamp 40 is an integral part of resilient elastic material such as metal. Suitably, the clamps 40 have circular cross-section with a material diameter in the order of D=2 to 3 mm.

Figures 2A, 2B, 2C, 3:
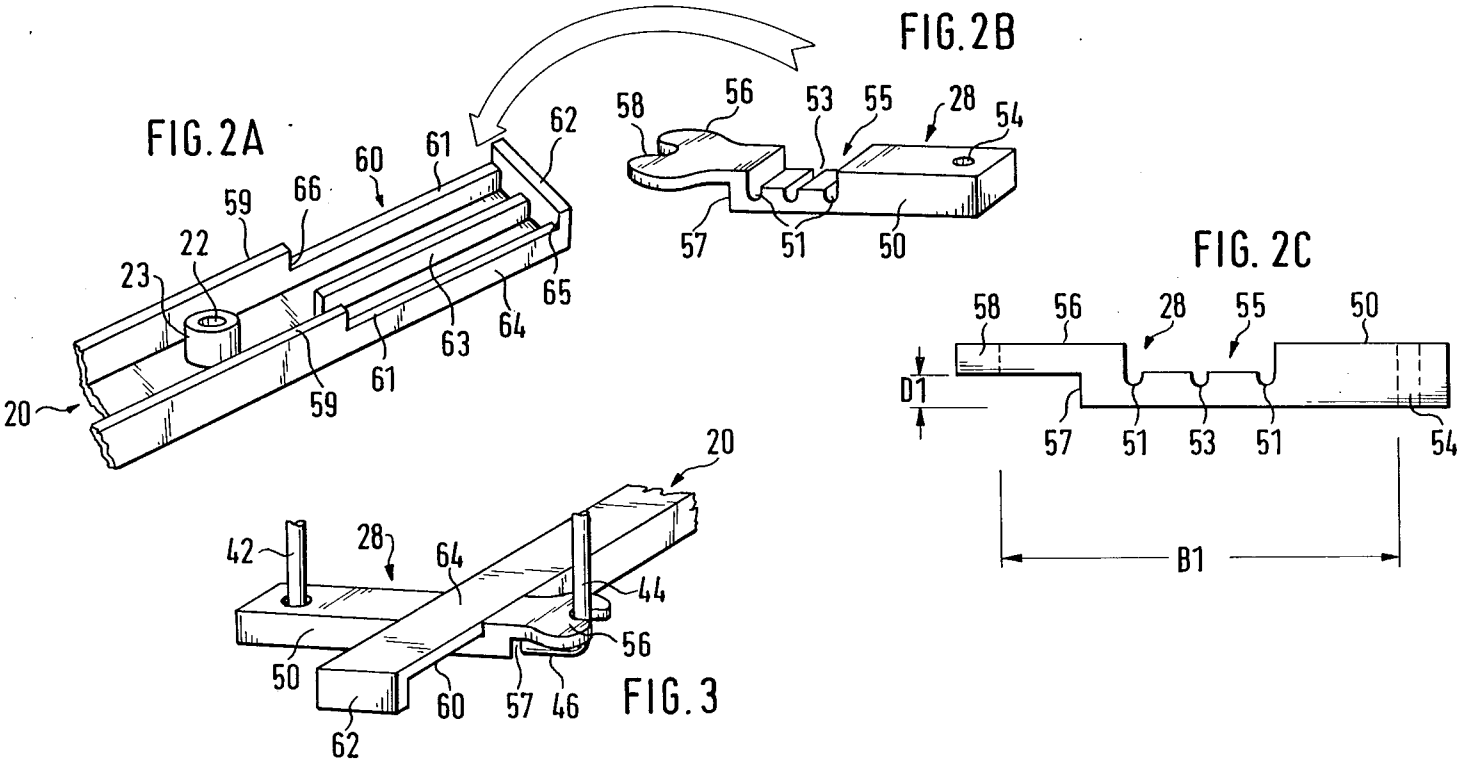
FIG. 2*a* is a perspective bottom view of the top portion of the bar for receiving an upper holding member.
FIG. 2*b* is a bottom view of the upper holding member for insertion in the top portion of the bar shown in FIG. 2*a;*
FIG. 2*c* is a cross-section through the upper holding member shown in FIG. 2*b;*
FIG. 3 is a perspective view of the top portion of the bar including upper holding member and inserted clamp.

The clamp 40 with its different-length arms 42 and 44 can be inserted under initial stress and at a slight inclination of its arm 42 relative to the lower part 12 into the respective holding member 26 or 28, when the projection 46 will engage beneath the latching portion 36 or 56. To this end the respective latching portion 36 or 56 is provided on the underside thereof with a recess of a height D1, which is somewhat larger than the thickness D of the material of the clamp 40. This is indicated in FIG. 2*c* for the upper holding member 28, where a step 57 has said height D1. The same applies to the lower holding member 26.

In FIG. 2*c*, the distance between the insertion hole 54 and the recess 58 is furthermore indicated as B1. This value is approximately equal to the distance B between the two arms 42 and 44. The same applies to the lower holding member 26, in which a recess 55 need not be provided.

It is especially convenient when the insertion hole 34 and the notch 38 in the latching portion 36 of the lower holding member 26 are both disposed along a line at a distance from the lower edge 16 of the carrier member 20, especially from the bottom part 12 of a stable folder, said distance being equal to the standardised spacing of the feed holes 15 of EDP paper sheets 11 from the side edge of the paper. A stack of paper sheets accommodated in the organizational aid will then have a side edge flush with the lower edge 16 so that, when a stable folder is in an upright position, the assembly is self-supporting while the paper sheets especially in the vicinity of the lower holding member 26 and its clamp 40 are not subjected to undue loads.

As will be apparent from FIG. 1, the upper holding member 28 is disposed for movement along the longitudinal direction of the bar 20. To this end the upper portion of the bar 20 is thinner and is formed on the underside thereof with a longitudinal recess 60 beneath which the upper holding member 28 engages and in which the transversely disposed upper holding member 28 slidably runs beneath the bar 20 while fully utilizing the longitudinal extension thereof. Only the top end of the bar 20 is provided with an end stop 62 which forms a step 65 to limit movement of the upper holding member 28 in upward direction. Downwardly, the movement of the upper holding member 28 is limited by a step 66. The distance between both steps 65 and 66 is selected to be such that the desired range of formats of EDP paper sheets 11 can easily be fully covered.

As will be apparent especially from FIGS. 2*a*, 2*b* and 2*c*, both the top portion of the bar 20 and the upper holding member 28 are formed with guide means which are configured as ridges or ribs, on the one hand, and grooves, on the other hand, and which interengage in the assembled state, ensure guiding of the upper holding member 28 and at the same time secure it against rotation.

As will be apparent from FIG. 2*a*, sidewalls 59 of the bar 20 terminate in guide ribs 61 of lesser height than that of the sidewalls 59 in the remaining region of the bar. At the steps 65 and 66, these guide ribs 61 terminate in the sidewalls 59 and the end stop 62, respectively. Additionally, this top portion of the bar 20 suitably is provided with a stiffening rib 63, which is joined to the end stop 62 and extends towards the opposite end of the bar 20; optionally this stiffening rib 63 may also be joined with a cylindrical part 23 which defines a hole 22 for receiving a fastening element 24.

As will be further apparent from FIG. 2*a*, the bar 20 is an open-bottomed box-type section which may be made by injection moulding. The various walls, ridges and ribs of the bar constitute an integral unit. A cover indicated at 64 is disposed above the recess 60 for overlapping engagement with the upper holding member 28.

The central portion of the upper holding member 28 is formed with a recess 55 whose dimensions correspond to the width of the bar 20. Furthermore, recessed portions in the form of grooves 51 and 53 are provided which extend transversely to the holding member 28 and are complementary with the guide ridges 61 and 63 for sliding engagement therewith.

FIG. 2*c* shows the upper holding member 28 in a side cross-sectional view, while FIG. 3 shows the assembled condition of bar 20 and upper holding member 28 which is overlapped by the cover 64 of the bar 20. The depth of the recess 55 is selected so as to be equal to the dimensions of the recess 60 in the bar 20. In this way a clearance-free compact assembly of bar 20 and movable upper holding member 28 is obtained.

Moreover, the arrangement as shown in FIG. 1 is such that the seating portions 30 and 50 as well as the latching portions 36 and 56 of both holding members 26 and 28 are disposed such that they define a surface which is flush with the upper surface of the bar to extend in coplanar relationship therewith. This ensures smooth support of the paper sheets 11 and provides for an attractive appearance of the arrangement.

When it is desired to make use of such an organization aid one merely has to turn the clamps 40 by anticlockwise or clockwise rotation from their latching portions 36 or 56, respectively. Thereupon a stack of EDP paper sheets 11 is picked up its punched or feed holes 15 as illustrated in FIG. 5, the shaft 48 of the arm 42 being pushed into the insertion hole 34 or 54, respectively. Then, the respective clamp 40 is selectively turned by anticlockwise or clockwise rotation until locked in the heart-shaped latching portion 36 or 56 in the central notch 38 or 58, respectively. This movement is indicated in FIG. 1 by double-arrows. When a wider or narrower stack of paper sheets 11 has to be accommodated it is merely necessary to move the upper holding member 28 along the longitudinal direction of the bar 20. The stack of paper sheets 11 itself will then maintain the desired distance between the two holding members 26 and 28 with the clamps 40 seated therein. No further fixing operations will be required.

I claim:

1. An organizational aid for paper sheets especially EDP paper sheets, each of said sheets including along the side margin thereof a equi-distantly spaced punched holes (15), said organizational aid comprising a strong carrier member (10, 12) having holding means (20, 26, 28) mounted thereon, and U-shaped clamps (40) detachably secured in said holding means (20, 26, 28) for accommodating and fixing the paper sheets (11), said holding means (20, 26, 28) including a bar (20) and an upper holding member (28) and a lower holding member (26) extending transversely to the bar (20), said U-shaped clamps secured to said upper holding member and to said lower holding member and being outwardly extended and passing through said punched holes, said bar includes a sheet support surface and said upper holding member and said lower holding member each being located with an upper surface no higher than said support surface to support said sheet in a corresponding planar position, said lower holding member (26) being fixedly joined to the bar (20) and said upper holding member (28) being movable along the longitudinal direction of the bar (20), and said two holding members (26, 28) have means releasably receiving said clamps (40).

2. The organizational aid as claimed in claim 1 wherein said holding means (20, 26, 28) is made of plastic .

3. The organizational aid as claimed in claim 1, wherein said holding means (20, 26, 28) is made of polyolefin, especially from polypropylene or polyurethane.

4. The organizational aid of claim 20 wherein said bar (20) and the lower holding member (26) are fixedly joined to the carrier member (10, 12).

5. The organizational aid of claim 1 wherein each of said holding members (26, 28) includes a seating portion (30, 50) and a latching portion (32, 52) extending transversely to the bar (20) in opposite directions for accommodating said U-shaped clamps (40).

6. The organizational aid of claim 1 wherein each of said holding members (26, 28) including a bar member having an open-topped insertion hole (34, 54) at one end thereof and a substantially symmetrical latching portion (36, 56) formed at the opposite end and having a central notch (38, 58), said clamp (40) after insertion in the insertion hole (34, 54) being releasably locked in said latching portions by rotation about one (42) of its arms.

7. The organizational aid of claim 6 wherein said insertion hole (34) and the notch (38) in the latching portion (36) of the lower holding member (26) are disposed at a distance from the lower edge (16) of the carrier member (10), especially the bottom (12) of a stable folder, which distance corresponds to the standard distance of the feed holes (15) of EDP paper sheets (11) from the side edge of the paper.

8. The organizational aid of claim 6 wherein said latching portion (36, 56) on the holding member (26, 28) including a projection which is offset upwardly relative to the underside of the holding member (26, 28) and including a recess which is continuous in the longitudinal direction of the bar, and said projection means having a predetermined spacing (D) from the carrier member (10, 12).

9. The organizational aid of claim 6 wherein said latching portions (36, 56) of the holding members (26, 28), have a heart-shaped configuration and a lesser thickness than the opposite seating portions (30, 50).

10. The organizational aid of claim 5 wherein at least the seating portion (30, 50) and the latching portion (36, 56) of the respective holding members (26, 28) have a top surface which is flush with the surface of the bar (20) and extends in coplanar relationship therewith.

11. The organizational aid of claim 1 wherein said U-shaped clamps (40) each have a straight arm (42) including a shaft (48) and a shorter arm (44) which is bent at the lower end thereof and has a projection (46) extending transversely towards said arm (42).

12. The organizational aid of claim 1 wherein said U-shaped clamp (40) is adapted to be inserted into the respective holding member (26, 28) under initial stress and at a slight inclination of its arm (42) relative to the bottom (12).

13. An organizational aid for paper sheets especially EDP paper sheets, each of said sheets including along the side margin thereof a equi-distantly spaced punched holes (15), said organizational aid comprising a strong carrier member (10, 12) having holding means (20, 26, 28) mounted thereon, and U-shaped clamps (40) detachably secured in said holding means (20, 26, 28) for accommodating and fixing the paper sheets (11), said holding means (20, 26, 28) including a bar (20) and an upper holding member (28) and a lower holding member (26) extending transversely to the bar (20), said lower holding member (26) being fixedly joined to the bar (20) and said upper holding member (28) being movable along the longitudinal direction of the bar (20), and said two holding members (26, 28) have means releasably receiving said clamps (40), and wherein the upper portion of the bar (20) has a thin portion extended in a longitudinal direction thereof and forming a recess (6) on the underside of the bar, said holding member (28) being slidably movable beneath the bar (20) within said recess and fully utilizing the longitudinal extension of said recess.

14. The organizational aid as claimed in claim 13, wherein said longitudinal movement of the upper holding member (28) is respectively limited upwardly and downwardly by step-like shoulders (65, 66) and a stop (62).

15. The organizational aid as claimed in claim 13, wherein said upper holding member (28) and the bar (20) have guide means (51, 53; 61, 63) for said upper holding member (28) whereby said upper holding member is guided for non-rotatable sliding movement.

16. The organizational aid of claim 13 wherein said bar (20) has at least one longitudinally extending ridge (61 63), said upper holding member includes a corresponding groove (51, 53) formed in the upper holding member (28) slidable on said ridge.

17. The organizational aid of claim 13 wherein said bar (20) is of open-bottomed box-like section having walls which define guide ridges (61, 63), said upper holding member having complementing grooves engaging said ridges.

18. The organizational aid of claim 13 wherein said upper holding member (28) is formed on the top surface thereof with a recess (55) of such width and depth as to correspond to the width of the bar (20) and the depth of the recess (60) formed in the bar (20), respectively.

19. The organizational aid of claim 3 wherein at least the upper portion of the bar (20) has a stiffening rib (63) of substantially the same height as the lateral outer guide ridges (61) and an upper end stop (62) joined to said stiffening rib.

20. The organizational aid of claim 19 wherein said upper portion of the bar includes a cylinder (23) integrally formed with the bar (20), a fastening element (24) secured to said top (62) for fastening the bar (20).

21. The organizational aid of claim 1 wherein each of said holding members (26, 28) includes a seating portion (30, 50) and a latching portion (32, 52) extending transverse to the bar (20) and in opposite directions of the bar (20) for accommodating said U-shaped clamps (40), and said seating portion (30, 50) and said latching portion (36, 56) of said holding members (26, 28) each have a top surface flush with the top surface of the bar (20) and extending in co-planar relationship therewith.

* * * * *

UNITED STATES PATENT AND TRADEMARK OFFICE

CERTIFICATE OF CORRECTION

PATENT NO. : 4,842,434

DATED : June 27, 1989

INVENTOR(S) : MANUAL FERREIRA-GODINHO

It is certified that error appears in the above-identified patent and that said Letters Patent is hereby corrected as shown below:

Col. 8, line 16, delete "20" and substitute therefor ---1---; Col. 10, line 16, delete "3" and substitute therefore ---17---.

Signed and Sealed this

Second Day of April, 1991

*Attest:*

HARRY F. MANBECK, JR.

*Attesting Officer*

*Commissioner of Patents and Trademarks*